United States Patent [19]

Hellwig et al.

[11] Patent Number: 4,849,670

[45] Date of Patent: Jul. 18, 1989

[54] ELECTRIC LAMP HAVING A PINCH SUPPORTED IN A SLEEVE-SHARED CAP

[75] Inventors: Paul Hellwig, Aachen; Dieter Wilhelm, Eschweiler-Duerweiss, both of Fed. Rep. of Germany

[73] Assignee: U.S. Philips Corporation, New York, N.Y.

[21] Appl. No.: 689,889

[22] Filed: Jan. 9, 1985

[30] Foreign Application Priority Data

Jan. 9, 1984 [DE] Fed. Rep. of Germany ..... 3400449

[51] Int. Cl.[4] ..... H01K 1/46; H01J 5/48

[52] U.S. Cl. ..... 313/318; 313/315

[58] Field of Search ..... 313/318, 315

[56] References Cited

U.S. PATENT DOCUMENTS 3,785,020 1/1974 Boros ..... 313/315
4,384,236 5/1983 Hellwig et al. ..... 313/318
4,473,770 9/1984 Baba et al. ..... 313/318
4,485,326 11/1984 Hellwig et al. ..... 313/318
4,489,252 12/1984 Eckhardt ..... 313/318

*Primary Examiner*—David K. Moore
*Assistant Examiner*—Mark R. Powell
*Attorney, Agent, or Firm*—David R. Treacy; Brian J. Wieghaus

[57] ABSTRACT

In an electrical lamp, whose envelope is closed by a pinch of rectangular cross-section, through which current-supply conductors are passed and which is supported in a cap between inwardly projecting parts, which seize around the narrower side faces of the pinch, according to the invention, one of the current supply conductors is bent backwards with its part projecting from the pinch along one of the narrower side faces and is clamped between pinch and lamp cap. Thus, it is possible to use a cap having only one bottom contact and nevertheless to secure the lamp envelope to the cap without additional means.

6 Claims, 2 Drawing Sheets

ELECTRIC LAMP HAVING A PINCH SUPPORTED IN A SLEEVE-SHARED CAP

BACKGROUND OF THE INVENTION

The invention relates to an electric lamp, comprising an envelope having a pinch, with two narrower side faces located opposite each other and two wider side faces located opposite each other. Current-supply conductors are passed through the pinch and connected to an electrical element supported in the envelope. The pinch is locked against rotation in a sleeve-shaped metallic cap by inwardly projecting parts thereof.

Such a lamp is known from DE OS No. 2941011 corresponding to U.S. Pat. No. 4,485,326. For locking against axial forces, the pinch can have a recess, which is engaged in a locking manner by a projecting part of the cap. In the known lamp, the cap has two bottom holes, in each of which a current-supply conductor projecting from the pinch is secured, for example by soldering. Such a cap is comparatively complicated and requires for mounting an accurate alignment of the two current-supply conductors.

The EU-PA No. 0078030, to which U.S. Pat. No. 4,489,252 corresponds, discloses an electric lamp having a pinch, whose cap has only one central bottom contact, in which one of the two current-supply conductors is secured. The lamp envelope is clamped with its pinch in a metal hood, which is in turn connected by means of solder to the lamp cap. This metal hood has at its edges a groove, in which the second current-supply conductor is arranged, which is likewise secured by means of solder. Thus, an electrical contact is established between this second current-supply conductor and the cap. However, this requires an additional metal hood and a comparatively laborious process of mounting the lamp.

SUMMARY OF THE INVENTION

This invention has for its object to provide an electric lamp having a pinch, whose envelope can be held without additional auxiliary means, such as a metal hood or cement, in a cap, which has only one bottom contact.

According to the invention, in an electric lamp of this kind mentioned one of the current-supply conductors is bent backwards with its end part projecting from the pinch along one of the narrow side faces of the pinch and is clamped between the pinch and the lamp cap.

In this lamp the current-supply conductor not coupled to the bottom contact of the cap is bent backwards with its end part projecting from the pinch along one of the narrow side faces of the pinch after the lamp envelope has been finished. Upon the subsequent insertion of the envelope into the cap, during which step the pinch is inserted between the inwardly-projecting parts of the cap, the current-supply conductor bent backwards is clamped between the pinch and the lamp cap in a position determined by and accurately defined by the inwardly projecting parts, while at the same time an electrical contact is established between the conductir end part bent backwards and the lamp cap.

In order to enlarge the contact surface, the conductor end part passed along a narrow side face of the pinch can be flat. The end part of a current-supply conductor projecting from the pinch may be flattened or may be a flat wire portion welded to a circular portion of the current-supply conductor.

According to a preferred embodiment of the lamp in accordance with the invention, the pinch is provided at one of its narrow side faces at the transition to a wide side face with a recess. It extends in the longitudinal direction of the pinch and receives a wire portion of circular cross-section, which is bent backwards and is clamped by an inwardly projecting part of the cap.

If the conductor part consists of a soft-annealed material, for example nickel or monel, upon the insertion of the lamp envelope into the cap, this conductor part is flattened and hence the contact surface between the conductor part and the inner wall of the cap is enlarged.

In order to further improve the contacting, according to a further embodiment of the invention, the conductor part clamped between the pinch and the cap is additionally connected to the cap by soldering or welding. In order to obtain a soldering connection, solder material is applied to the conductor part and/or to the inner side of the cap, which solder material is heated from the outside after the insertion of the pinch into the cap. The welding connection between the cap and the conductor part is obtained, for example, by means of a laser beam.

BRIEF DESCRIPTION OF THE DRAWINGS

Embodiments of the lamp according to the invention are now described more fully with reference to the drawing. In the drawing.

DESCRIPTION OF THE PREFERRED EMBODIMENTS

Figure 1:
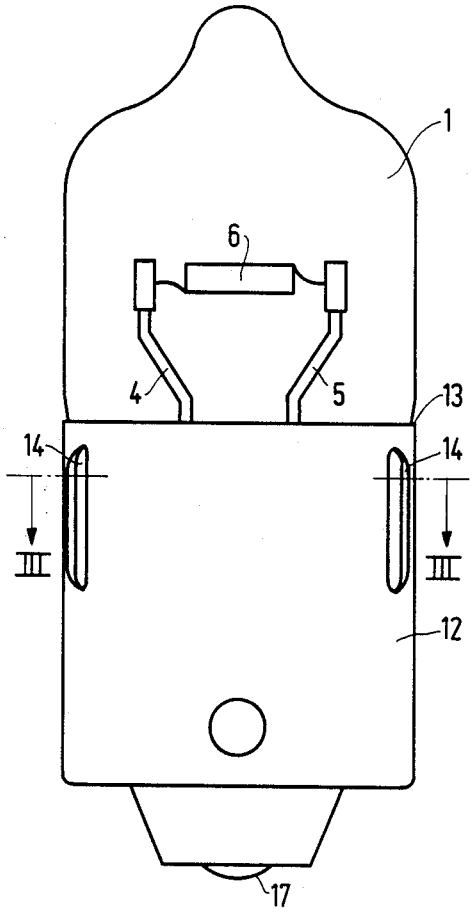
FIG. 1 is a side elevation of an incandescent lamp having a bayonette cap.
Figure 2:
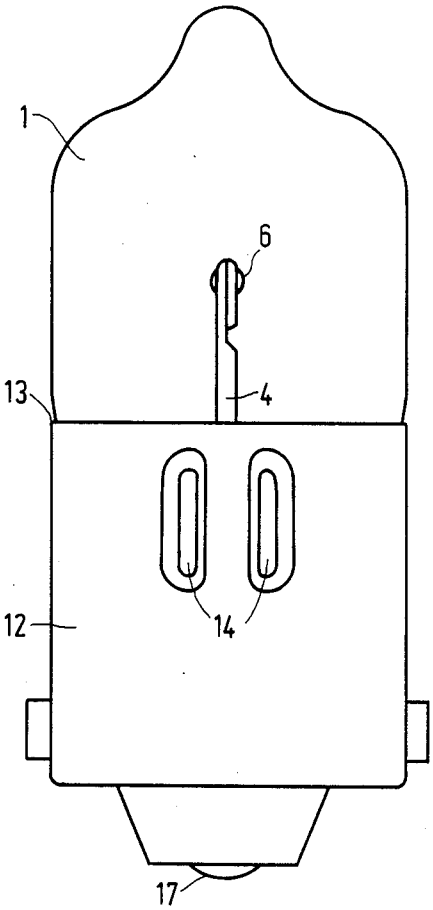
FIG. 2 is an elevation of the lamp of FIG. 1 rotated through 90° about the longitudinal axis of the lamp.
Figure 3:
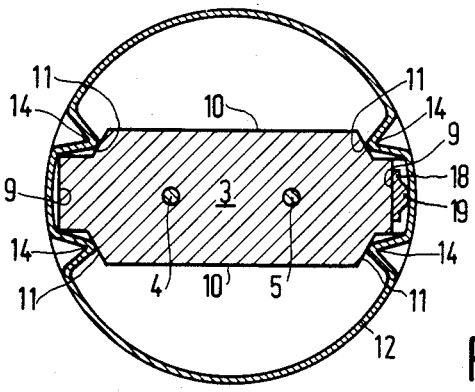
FIG. 3 is a cross-sectional view of the lamp of FIG. 1 taken on the line III—III.

In FIGS. 1 to 3 there is shown an envelope 1 of a halogen incandescent lamp. The envelope 1 consists, for example, or hard glass and has a pinch 3 having a substantially rectangular cross-section in which current-supply conductors 4 and 5 are embedded. Conductors 4 and 5 are connected to filament 6. The ends of conductors 4 and 5 project from the pinch 3. The narrow side faces 9 of the pinch 3 are provided at the transition to the wide side faces 10 with bevelled parts 11 (FIG. 3).

Figure 4:
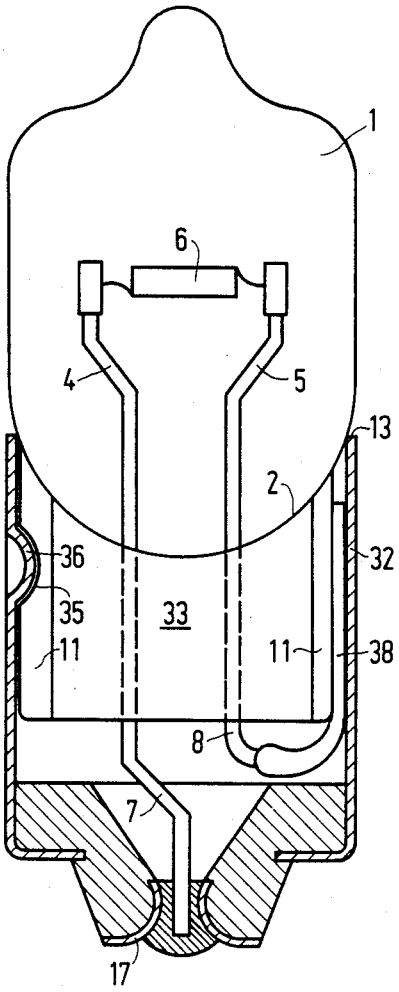
FIG. 4 is the side elevation of another embodiment with a cap in longitudinal sectional view.

The lamp envelope 1 is inserted with its pinch 3 into a sleeve-shaped cap 12 of metal that it abuts against the cap edge 13 (FIG. 4). The cap 12 has four corrugated projections 14 on its conductive cylindrical surface, which are pressed inwardly and between which the pinch 3 is inserted for a pressure fit.

The end part of the current-supply conductor 4 is passed into a central cap contact 17 and is soldered there. The end part of the current-supply conductor 5 has welded to it a flattened conductor part 18, which consists of a soft-annealed material, for example nickel or monel, and has at its center an elongate embossed part 19. This flat conductor part 18 is bent backwards along one of the narrow side faces 9 of the pinch 3 and is clamped between the pinch 3 and the lamp cap 12 upon insertion of the envelope 1 into the cap 12 so that an electrical contact is established between the conductor part 18 and the cap 12.

Figure 5:
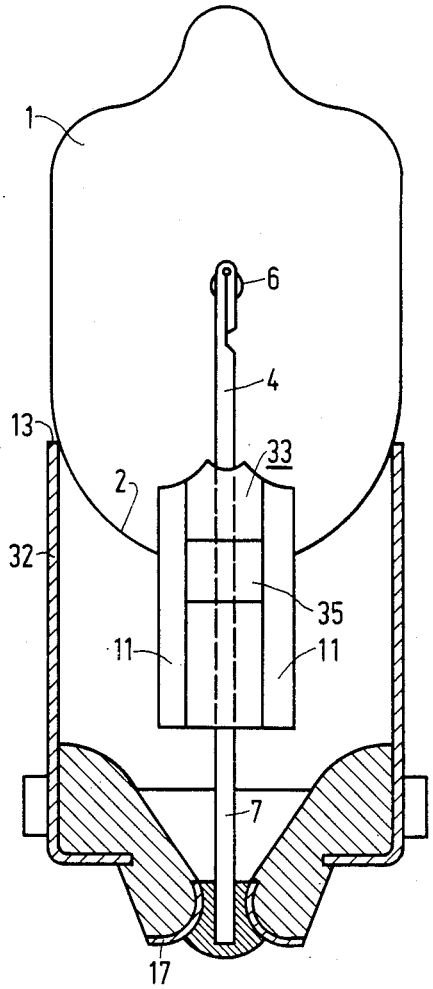
FIG. 5 is an elevation of the lamp of FIG. 4 rotated through 90° about the longitudinal axis of the lamp.

In FIGS. 4 and 5, like reference numerals designate like parts in FIGS. 1 to 3. The pinch 33 has a recess 35, which is engaged by a projection 36 of the cap 32 for axial locking of the envelope 1. The end part 8 of the current-supply conductor 5 is welded to a wire 38 of nickel or monel, which is flattened wjhen the envelope 1 is mounted in the cap 32. In these Figures, it is not visible that the cap 32 has similar projections 14, which, like in FIGS. 1 to 3, prevent the envelope 1 from rotational movement.

Figure 6:
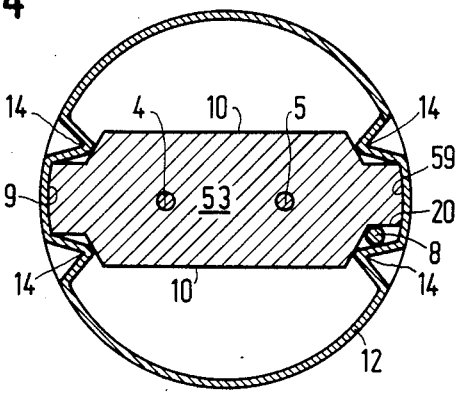
FIG. 6 is a sectional view corresponding to that of FIG. 3 of the lamp in a further embodiment having a pinch which is shaped slightly differently.

In another embodiment shown in FIG. 6, the pinch 53 is provided at one of its narrow side faces 59 at the transition between the wide side face 10 with a recess 20. Each face 59 extends in the longitudinal direction of the pinch 53 and receives the end part 8 of circular cross-section of the current-supply conductor 5. The end part 8 is bent backwards and gets into clamping contact with one of the inwardly projecting cap parts 14 upon insertion of the envelope 1 into the cap 12.

What is claimed is:

1. In an electric lamp comprised of a glass envelope comprising a pinch which includes a pair of narrow side faces located opposite each other and a pair of wide side faces located opposite each other, said side faces defining a longitudinal direction of said pinch and forming a substantially rectangular cross-section, a pair of current-supply conductors embedded within the pinch, each conductor having an end part projecting from the pinch, and an electric element contained in the envelope and bridged across the pair of conductors;

the improvement wherein the lamp further comprises a lamp cap comprising a conductive cylindrical shell having four inwardly corrugated projections on its cylindrical surface;

the pinch of the envelope being disposed within the projections of the lamp cap and locked against axial and rotational movement by the projections; one end part of its associated conductor being bent along one of the narrow side faces of the pinch and clamped between the pinch and the shell of the lamp cap so as to make electrical contact therewith.

2. A lamp as claimed in claim 1, characterized in that the end part of the current conductor passed along the narrow side face of the pinch is flat.

3. A lamp as claimed in claim 1, characterized in that the pinch comprises a recess at the transition of one of its narrow side faces and its wide side face, the recess extends in the longitudinal direction of the pinch and receives the end part of one of the current conductors, the end part being bent backwards and clamped to contact with one of the inwardly projecting parts of the cap.

4. A lamp as claimed in claim 1, characterized in that the conductor end part consists of a soft-annealed material.

5. A lamp as claimed in claim 2, characterized in that the conductor end parts consists of a soft-annealed material.

6. A lamp as claimed in claim 3, characterized in that the conductor end part consists of a soft-annealed material.

* * * * *